United States Patent [19]

Risby

[11] Patent Number: 4,661,989

[45] Date of Patent: Apr. 28, 1987

[54] COMPRESSIBLE PACKING BAG

[76] Inventor: Bengt Risby, Alsätrav. 190, 127 36 Skärholmen, Sweden

[21] Appl. No.: 781,109

[22] Filed: Sep. 27, 1985

[51] Int. Cl.[4] ..... A45F 4/00

[52] U.S. Cl. ..... 383/2; 383/120; 150/52 E

[58] Field of Search ..... 224/153; 383/2, 120; 190/106, 107, 103; 150/52 E

[56] References Cited

U.S. PATENT DOCUMENTS 2,795,830 6/1957 Leatherman ..... 24/141
3,912,138 10/1975 Pava .

OTHER PUBLICATIONS

"Tight Wad Compression Stuff Bag", full-color brochure; marketed by Everest Elite, Div. of Slumberjack, P.O. Box 31405, Los Angeles, CA 90031-0405.

*Primary Examiner*—Stephen Marcus
*Assistant Examiner*—David Voorhees
*Attorney, Agent, or Firm*—Nils H. Ljungman

[57] ABSTRACT

A packing bag made of a strong cloth material, combined with a tensioning device which facilitates simple but effective adjustment of the volume of the compressible contents therein. A high degree of compression is achieved by placing two substantially rigid, elongated, stiffening members along the sides of the bag and attaching one or two straps thereto with fasteners. The distance between the stiffening members is controlled by the straps, allowing for the alteration of the volume of the bag. The pressure which appears at compression is divided along the sides of the bag because of the stiffening members, and is not confined to the areas where the straps are attached. The bag can be designed with the opening at either end, thus taking the shape of a cylinder, or with the opening at a wider end, thus taking on a conical shape prior to compression and a cylindrical shape after compression. In alternative embodiments of the invention, the opening can be placed between the stiffeners instead of on either end, enabling easier packing of a larger-size bag, or the bag can be designed in the shape of a cone with the opening at the wide end, so that only one strap is required for adjustment of the upper parts of the stiffening members while the lower parts thereof are firmly attached to the bag.

20 Claims, 6 Drawing Figures

FIG. 1
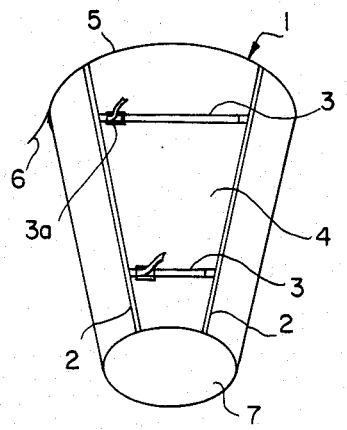
FIG. 2
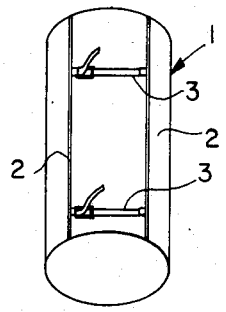
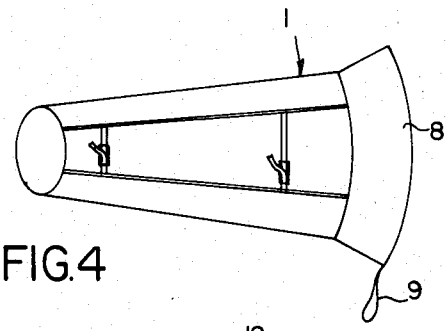
FIG.4
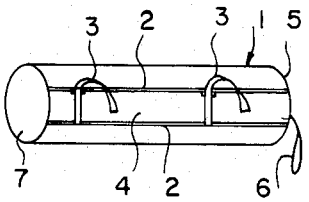
FIG.3
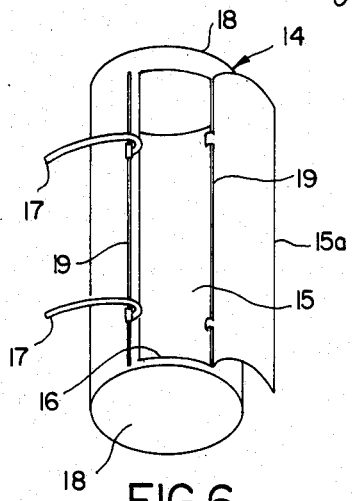
FIG.6
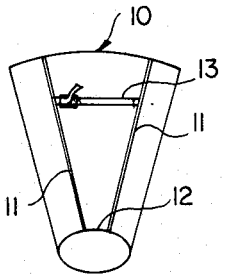
FIG. 5

COMPRESSIBLE PACKING BAG

BACKGROUND OF THE INVENTION

1. Field of the Invention

The invention relates generally to a packing bag and, more particularly, to a packing bag combined with a pulling device, which makes it possible to alter the volume of the bag.

2. Description of the Prior Art

Backpacking and camping have had a long felt need for a compact means of packing articles. At various times there is often a need to be able to reduce volume in a simple way with ease when packing voluminous and soft objects or material. In an activity such as camping, the need is especially acute since it is not readily possible to change the volume of the most common prior art packing bags today. This results in difficulties in the packing of, for example, sleeping bags, which form units which are still of a size too great to conveniently transport. The packing bags on the market today, where the volume can be adjusted, do not have an even shape after compression, and so efficient compression is not achieved.

An example of the prior art resides in the "Tight Wad Compression Stuff Bag" marketed by Everest Elite, a division of Slumberjack, P.O. Box 31405, Los. Angeles, Calif. 90031-0405. A brochure showing the bag, enclosed with the Information Disclosure Statement by Applicant filed with the application, is incorporated herein by reference. This bag is substantially cylindrical in shape and has four straps to compress the contents thereof when filled with compressible material. The straps are affixed directly to the fabric of the bag which concentrates the forces of the straps directly onto the attachment points thereof. In order to reduce the stresses at the attachment points of the straps and keep the bag somewhat cylindrical, a large number of straps are used. In the 21 inch long bag, four straps are used.

An example of a backpacking and camping system is found in U.S. Pat. No. 3,912,138, which patent is incorporated herein by reference.

OBJECT OF THE INVENTION

The object of the invention is to achieve, with a simple movement, effective adjustment of the volume of a packing bag made of cloth or a similar flexible material.

SUMMARY OF THE INVENTION

In order to easily pack contents so that they take up as little space as possible, the contents must be tightly compressed. By placing or fastening stiffeners along the sides of the bag and attaching a small number of straps with fasteners, a high degree of compression is achieved. The distance between the stiffeners is controlled by the straps and, in this way, the volume of the bag can be altered. Because of the stiffeners, the pressure which appears at compression is divided along the sides of the bag, and is not confined to the areas where the straps are fastened. The bag can be made with the opening at either end and thus take the shape of a cylinder. The placing of the opening and alternative designs enable the bag to have a conical shape prior to compression, and a cylindrical shape after compression. In an alternative embodiment of the invention, no opening is provided at either end of the bag, but an opening is placed between the stiffeners. This makes packing easier, since the bag, when made in large sizes, might be difficult to place on its end. The bag can also be designed in the shape of a cone with the opening at the wide end, so that only one clasp is needed. In this embodiment, only the upper part of the stiffeners need be adjusted while the lower part is firmly attached. On the models of the packing bag which have the opening located in one of the short ends, the opening can also be equipped with a so-called "snow lock" in order to provide a tighter closure.

BRIEF DESCRIPTION OF THE DRAWINGS

Preferred embodiments of the invention are schematically illustrated in the following drawings, wherein:

FIG. 1 shows a front perspective view of an unfolded, conical bag embodiment;

FIG. 2 shows a front perspective view of an unfolded, cylindrical bag embodiment;

FIG. 3 shows a front perspective view of the embodiments of FIGS. 1 and 2, when compressed;

FIG. 4 shows a front perspective view of the embodiment of FIG. 1, equipped with so-called "snow locks";

FIG. 5 shows a front perspective view of an embodiment having a single clasp; and FIG. 6 shows a front perspective view of an embodiment where an opening in the bag is placed between the stiffeners.

DESCRIPTION OF THE PREFERRED EMBODIMENTS

FIG. 1 shows a bag 1 which is preferably made of a strong cloth material such as a canvas or even a material such as a urethane-coated pack cloth. FIG. 1 shows the bag 1 in the position when it can be packed, that is, unfolded. Two stiffeners 2 are preferably sewn into the fabric of the bag 1 in two outermost positions of the cloth material, thereby providing the bag 1 with a maximum volume. The stiffeners 2 may be made from a natural or a synthetic material. An example of a natural material is wood, while a synthetic material could be a plastic, such as nylon or fiber glass reinforced with a resin, such as an epoxy resin. In the embodiment shown in FIG. 1, the fabric of the bag is preferably sewn such that the bottom portion 7 is expandable to allow the stiffeners 2 to be as far apart as possible to provide a maximum packing volume. Typically, the stiffeners 2 are disposed from about 50% to about 80% of the way around the bag 1. The stiffeners 2 extend along substantially 80% to about 95% of the length of the bag 1 when filled. In this embodiment, the top has a larger diameter than the bottom 7. Straps 3 are shown in the position when they are not tightened. The straps 3 are held tight by means of fasteners 3*a* which are preferably buckles. A material panel 4 is preferably sewn or fastened between the two stiffeners 2. In an upper end of the bag, opposite the bottom portion 7, is an opening 5. A string 6 is shown with which the opening 5 in the upper end of the bag 1 may be closed. The string 6 pulls together a top portion of the bag 1, which top portion comprises a fabric cover with the string 6 sewn therein for closure.

Referring now to FIGS. 2 and 3, a cylindrical embodiment is shown. In the cylindrical model, the design, apart from the shape, is similar to FIG. 1 and is shown in FIG. 2. FIG. 3 shows the bag when compressed. The reference numerals in FIG. 3 are otherwise the same as for FIG. 1. When compressed, the two stiffeners 2 are typically substantially parallel to one another, as well as a lengthwise portion of the bag 1. The bag 1 is preferably cylindrical and longer than it is wide when packed, and thus forms a convenient shape which is easily carried or stowed.

FIG. 4 is substantially similar to FIG. 1, apart from the so-called "snow lock" 8 where closure is made with a string 9 and the cloth attached thereto.

FIG. 5 shows an embodiment of a bag 10 where only the upper part of the stiffeners 11 can be adjusted, since the lower part 12 is affixed and there is only one strap 13.

FIG. 6 shows an embodiment of a bag 14 which is adapted for bags with large volumes. Here both ends 18 are closed. This embodiment has an opening 15 in front, with a lid 15*a* disposed between the stiffeners 19. Closing of the lid 15*a* is done with a zip fastener or string 16. Straps 17 are attached to fasteners (not shown) like the buckles 3*a* shown in FIG. 1, to hold the lid 15*a* in place when the opening 15 is closed. In this embodiment, the straps 17 may be removed from the fasteners.

The bag of FIG. 1 is typically about 24–30 inches long. The embodiment of FIG. 5 is typically about 21–24 inches long, and the larger embodiments are typically about 36 inches long.

The bag made according to the present invention has up to a 40% larger capacity than a typical prior art bag, and when the straps 3 are pulled tight to a given tension, can be up to 40% smaller than the aforementioned prior art bag. The expandable quality of the bag makes the packing of items such as a sleeping bag or a tent very easy.

The invention as described hereinabove in the context of a preferred embodiment is not to be taken as limited to all of the provided details thereof, since modifications and variations thereof may be made without departing from the spirit and scope of the invention.

What is claimed is:

1. A bag having a variable volume and being substantially cylindrical when substantially fully packed, said bag having an exterior portion, an interior portion and a longitudinal axis, said bag comprising:

a flexible sheet material for enclosing and compressing contents within said bag when in use;

said flexible sheet material comprising substantially one unitary piece and forming said exterior portion of said bag;

said flexible sheet material having two separate portions spaced apart at a substantial distance from one another;

two substantially straight, substantially rigid, elongated, stiffening members being disposed and fastened at said two spaced-apart portions of said flexible sheet material;

said elongated members each having an elongated axis along the elongation thereof;

tensioning means comprising first tensioning means and second tensioning means;

said first tensioning means comprising at least one strap means, said at least one strap means having first attachment means attached directly at a first of said substantially straight, rigid, elongated, stiffening members to transfer tension in use from said at least one strap means to said first one of said two substantially rigid, straight, elongated, stiffening members, said tension of said at least one strap means being transferred substantially transversely to said elongated axis of said first one of said two substantially straight, rigid, elongated, stiffening members when said bag is substantially fully packed with compressible contents and with said at least one strap means tensioned;

said at least one strap means having second means for attachment attached directly at a second of said substantially straight, rigid, elongated stiffening members to transfer tension from said at least one strap means to said second one of said two substantially straight, rigid, elongated, stiffening members, said tension of said second attachment means being transferred substantially transversely to said elongated axis of said second one of said two substantially rigid, straight, elongated, stiffening members when said bag is substantially fully packed with said compressible contents and with said at least one strap means tensioned; and said second tensioning means being for transferring tension directly to said first stiffening member and substantially transversely to said elongated axis of said first one of said two substantially rigid, straight, elongated, stiffening members when said bag is substantially fully packed with said compressible contents and said second tensioning means tensioned, said second tensioning means being disposed at a position a substantial distance from said first attachment means, said second tensioning means for transferring tension substantially directly and transversely to said elongated axis of said second one of said two substantially rigid, straight, elongated, stiffening members when said bag is substantially fully packed with said compressible contents and said second tensioning means being tensioned at a position disposed from said first attachment means, said two substantially straight, rigid, elongated, stiffening members, disposed and fastened at said two spaced-apart portions, which are disposed at ends of said flexible sheet material for enclosing contents within said bag, whereby said elongated axes of said two substantially rigid, elongated, straight, stiffening members are substantially in appropriate alignment with said longitudinal axis of said bag when said bag is substantially fully packed with said compressible contents and said at least one strap means is tensioned to a predetermined tension, and whereby said compressible contents of said substantially fully packed bag are compressed in use by said tensioning of said at least one strap means to form a substantially cylindrical shape.

2. The bag according to claim 1 wherein said flexible sheet material being cloth for enclosing contents within said bag extends substantially more than half way around said bag.

3. The bag according to claim 1 including a panel of flexible sheet material, said panel being disposed between said two spaced-apart portions of said flexible sheet material, said panel and said flexible sheet material being disposed to enclose contents within said bag when in use and when being packed.

4. The bag according to claim 1 wherein said second tensioning means comprises a second strap means.

5. The bag according to claim 2 wherein said second tensioning means comprises a second strap means.

6. The bag according to claim 1 including a bottom portion, said bottom portion and said flexible sheet material being joined for enclosing and containing contents within said bag during packing and when in use.

7. The bag according to claim 3 including a bottom portion, said bottom portion and said flexible sheet material being joined for enclosing and containing contents within said bag during packing and when in use.

8. The bag according to claim 6 wherein said bottom portion comprises said second tensioning means for transferring tension substantially transversely to said elongated axis of said two substantially rigid, elongated, stiffening members.

9. The bag according to claim 1 wherein said two substantially rigid, elongated, stiffening members are sewn into said two spaced-apart portions of said flexible sheet material.

10. The bag according to claim 9 wherein said bag has two ends, and wherein said two substantially rigid, elongated, stiffening members extend substantially from said one end of said bag substantially to said other end of said bag.

11. The bag according to claim 10 wherein said two substantially rigid, elongated, stiffening members are disposed such that when said first and second tensioning means are tensioned when said bag is substantially fully packed with said compressible contents, said longitudinal axes of said two substantially rigid, elongated, stiffening members are substantially parallel to one another.

12. The bag according to claim 3 wherein said panel is attached to one of said two spaced-apart portions of said flexible sheet material.

13. The bag according to claim 3 wherein said panel has means for attachment about its periphery to said flexible sheet material for enclosing contents within said bag.

14. The bag according to claim 1 wherein said at least one strap means comprises a strap being sewn to transfer tension to said first one of said two substantially rigid, elongated, stiffening members and wherein said strap includesa buckle means being sewn for attachment to transfer tension to said second one of said two substantially rigid, elongated, stiffening members.

15. The bag according to claim 10 wherein one of said two ends of said bag is a top end, and wherein said top end of said bag comprises a flexible sheet material having a drawstring running about its periphery, said drawstring for closing said top end of said bag when pulled.

16. The bag according to claim 1 wherein said flexible material for enclosing contents within said bag comprises cloth.

17. The bag according to claim 3 wherein said panel comprises cloth.

18. A bag having a variable volume, said bag being compressible and substantially cylindrical at least when fully packed, said bag having an exterior portion, interior portion and a longitudinal axis, said bag comprising:

a flexible sheet material for enclosing and compressing contents within said bag when in use;

said sheet material forming said exterior portion of said bag and comprising substantially one unitary piece;

two substantially straight, substantially rigid, elongated, stiffening members being disposed and fastened at two spaced apart portions of said sheet material;

said flexible sheet material for enclosing contents within said bag extends substantially more than half way around said bag;

at least two strap means, each having first means for being attached at, for applying force directly to, a first of said stiffening members;

each first attachment means being disposed a substantial distance, one from the other;

each said strap means having second attachment means for being attached at for applying force directly to a second of said two straight, stiffening members;

said second attaching means for each of said straps being disposed apart a distance substantially equal to said distance of said displacement of said two first attachment means on said first straight stiffening member; and said two straight stiffening members being disposed and attached in said flexible sheet material such that tensions produced by said strap means and said attachment means subsequent to packing are distributed by said straight stiffening members throughout a substantial portion of said sheet material, whereby said elongated stiffening members are substantially aligned with said longitudinal axis of said bag when said bag is substantially fully packed with substantially compressible contents and when said at least two straps are tensioned to a predetermined tension, and whereby said compressible contents of said substantially fully packed bag are compressed in use by said tensioning of said at least two straps to form a substantially cylindrical shape.

19. The bag according to claim 18 wherein said at least two strap means consist essentially of two strap means.

20. A bag having a variable volume and being substantially cylindrical when substantially fully packed, said bag having an exterior portion, an interior portion, two ends and a longitudinal axis, said bag comprising:

a flexible cloth material for enclosing and compressing contents within said bag when in use;

said flexible cloth material comprising substantially one unitary piece and forming said exterior portion of said bag;

said flexible cloth material having two separate portions spaced apart at a substantial distance from one another;

two substantially straight, substantially rigid, elongated, stiffening members being disposed and fastened at said two spaced-apart portions of said flexible cloth material;

said straight, elongated members each having an elongated axis along the elongation thereof;

tensioning means comprising first tensioning means and second tensioning means;

said first tensioning means comprising at least one strap means, said at least one strap means having first attachment means attached directly at a first of said substantially straight, rigid, elongated, stiffening members to transfer tension in use from said at least one strap means to said first one of said two substantially rigid, straight, elongated, stiffening members, said tension of said at least one strap means being transferred substantially transversely to said elongated axis of said first one of said two substantially rigid, elongated, stiffening members when said bag is substantially fully packed with compressible contents and with said at least one strap means tensioned;

said at least one strap means having second means for attachment attached directly at a second of said two substantially straight, rigid, elongated stiffening members to transfer tension from said at least one strap means to said second one of said two substantially straight, rigid, elongated, stiffening members, said tension of said second attachment means being transferred substantially transversely to said elongated axis of said second one of said two substantially rigid, straight, elongated, stiffening members when said bag is substantially fully packed with said compressible contents and with said at least one strap means tensioned; and said second tensioning means for transferring tension directly and substantially transversely to said elongated axis of said first and second of said two stiffening members when said bag is substantially fully packed with said compressible contents and said second tensioning means tensioned;

said second tensioning means being disposed at a position a substantial distance from said first attachment means and comprising a first of said end portions of said bag;

said second tensioning means being tensioned by tensioning of said first attachment means and transferring of said tension from said first tensioning means through said two substantially straight, rigid, elongated, stiffening members to said first end portion;

said two substantially straight, rigid, elongated, stiffening members, disposed and fastened at said two spaced-apart portions being disposed at ends of said flexible cloth material; and said flexible cloth material for enclosing contents within said bag extends substantially more than half way around said bag, whereby said elongated axes of said two substantially rigid, elongated, straight, stiffening members are substantially in appropriate alignment with said longitudinal axis of said bag when said bag is substantially fully packed with said compressible contents and said at least one strap means is tensioned to a predetermined tension, and whereby said compressible contents of said substantially fully packed bag are compressed, in use, by said tensioning of said at least one strap means to form a substantially cylindrical shape.

* * * * *